US005697389A

United States Patent [19]

Lai

[11] Patent Number: 5,697,389

[45] Date of Patent: Dec. 16, 1997

[54] POWDER STORAGE AND APPLICATOR DEVICE

[76] Inventor: Peggy C. Lai, No. 3, Lane 223, Sec. 2, Yuan-Huan N. Rd., Feng-Yuan City, Taichung Hsien, Taiwan

[21] Appl. No.: 723,257

[22] Filed: Sep. 30, 1996

[51] Int. Cl.[6] ..... A45D 33/02

[52] U.S. Cl. ..... 132/307; 132/298; 132/315; 132/306; 132/293; 206/581

[58] Field of Search ..... 132/293, 298, 132/299, 306, 307, 315; 206/229, 581, 823, 235; 220/335, 343, 264

[56] References Cited

U.S. PATENT DOCUMENTS

| | | | |
|---|---|---|---|
| 1,860,079 | 5/1932 | Coryell | 132/298 |
| 1,922,326 | 8/1933 | Rauber et al. | 132/306 |
| 1,931,004 | 10/1933 | Krueger | 132/298 |
| 3,199,743 | 8/1965 | Berger | 132/298 |
| 5,515,875 | 5/1996 | Acker et al. | 132/298 |

*Primary Examiner*—Gene Mancene
*Assistant Examiner*—Pedro Philogene
*Attorney, Agent, or Firm*—Bacon & Thomas

[57] ABSTRACT

A powder storage and applicator device including a casing defining a top-open chamber, which holds a powdered beauty product, a screen covered on the casing over the top-open chamber, a detachable cover plate adapted for covering on the casing over the screen, and a flat handle pivoted to the casing, wherein when the handle is extended out for the holding of the hand, the powdered beauty product can be applied to the body by: patting the body with the screen or rubbing the screen over the body.

5 Claims, 7 Drawing Sheets

POWDER STORAGE AND APPLICATOR DEVICE

BACKGROUND OF THE INVENTION

The present invention relates to powdered beauty product application devices, and relates more particularly to a powder storage and applicator device for holding a powdered beauty product, and applying the product to the body of a person by patting.

When applying a talcum powder, baby powder, or any of a variety of powdered beauty product to the body, a powder puff or like device shall be used (see FIG. 1). However, using a powder puff cannot evenly apply a powdered beauty product to the body. During application, the applied powdered beauty product tends to drop from the powder puff to contaminate the ground, clothes, etc., and much of the applied powdered beauty product is wasted. Furthermore, regular powder puffs are commonly made from sponge in shape convenient for holding in hand. Using these powder puffs cannot reach one's back. Therefore, it is difficult to apply a powdered beauty product to the back of the body with a conventional powder puff without the help of another person.

SUMMARY OF THE INVENTION

The present invention has been accomplished under the circumstances in view. It is one object of the present invention to provide a powder storage and applicator device which can be conveniently operated to evenly apply a powdered beauty product to the body, without causing a loss. It is another object of the present invention to provide a powder storage and applicator device which can be conveniently operated by oneself, to apply a powdered beauty product to any part of one's body. It is still another object of the present invention to provide a powder storage and applicator device which can be used as a manual massaging tool. According to one aspect of the present invention, the powder storage and applicator device comprises a casing defining a top-open chamber, which holds a powdered beauty product, a screen covered on the casing over the top-open chamber, a detachable cover plate adapted for covering on the casing over the screen, and a flat handle pivoted to the casing. When the handle is extended out for the holding of the hand, the powdered beauty product can be applied to the body by patting the body with the screen or rubbing the screen over the body. According to another aspect of the present invention, press lock means are provided for locking the handle in a first position closed on the easing and the screen, or a second position extended out of the casing and in longitudinal alignment with it. According to still another aspect of the present invention, the casing has a plurality of raised portions raised from the bottom, and adapted for massaging.

DETAILED DESCRIPTION OF THE PREFERRED EMBODIMENTS

Figure 1:
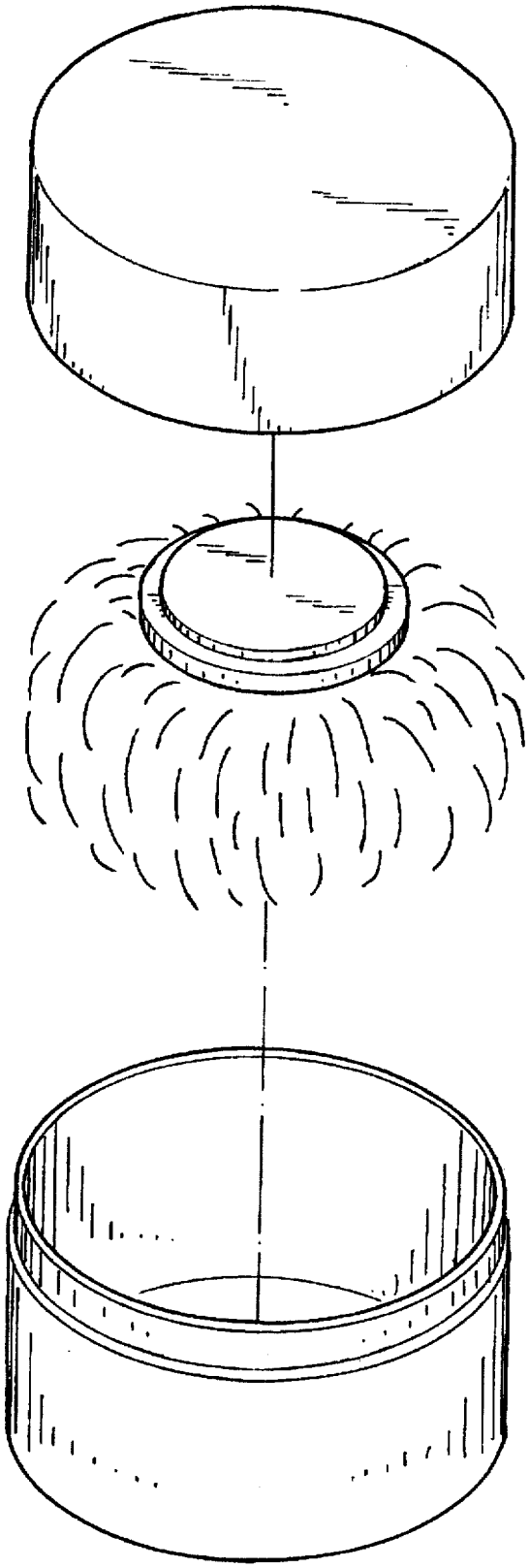
Fig. 1 PRIOR ART
FIG. 1 is an exploded view of a powder case and a powder puff according to the prior art.
Figure 2A:
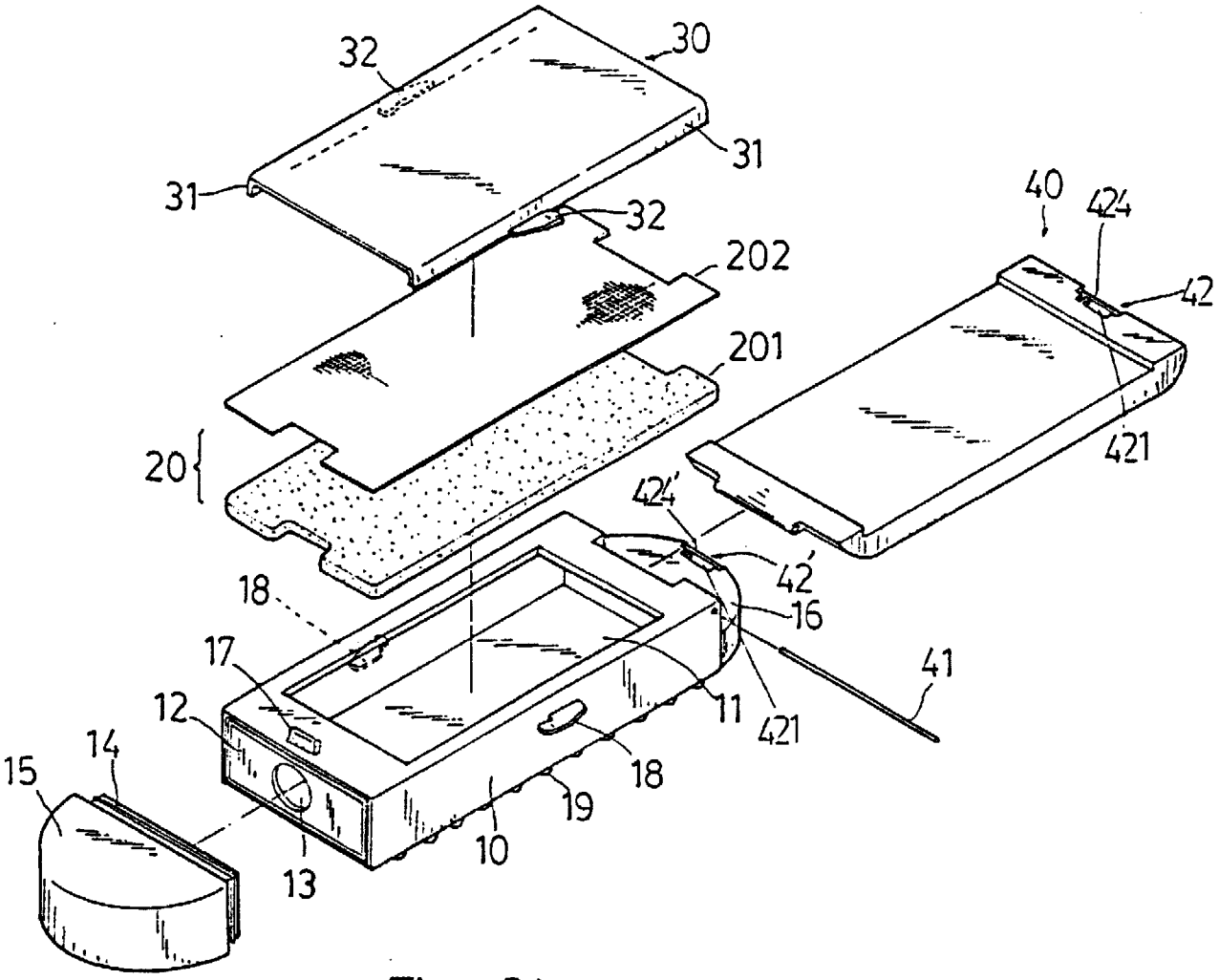
FIG. 2A is an exploded view of a powder storage and applicator device according to one embodiment of the present invention.

Referring to FIG. 2A, a power storage and applicator device in accordance with the present invention is generally comprised of a casing 10, a screen 20, a cover plate 30, and a flat handle 40.

Figure 2B:
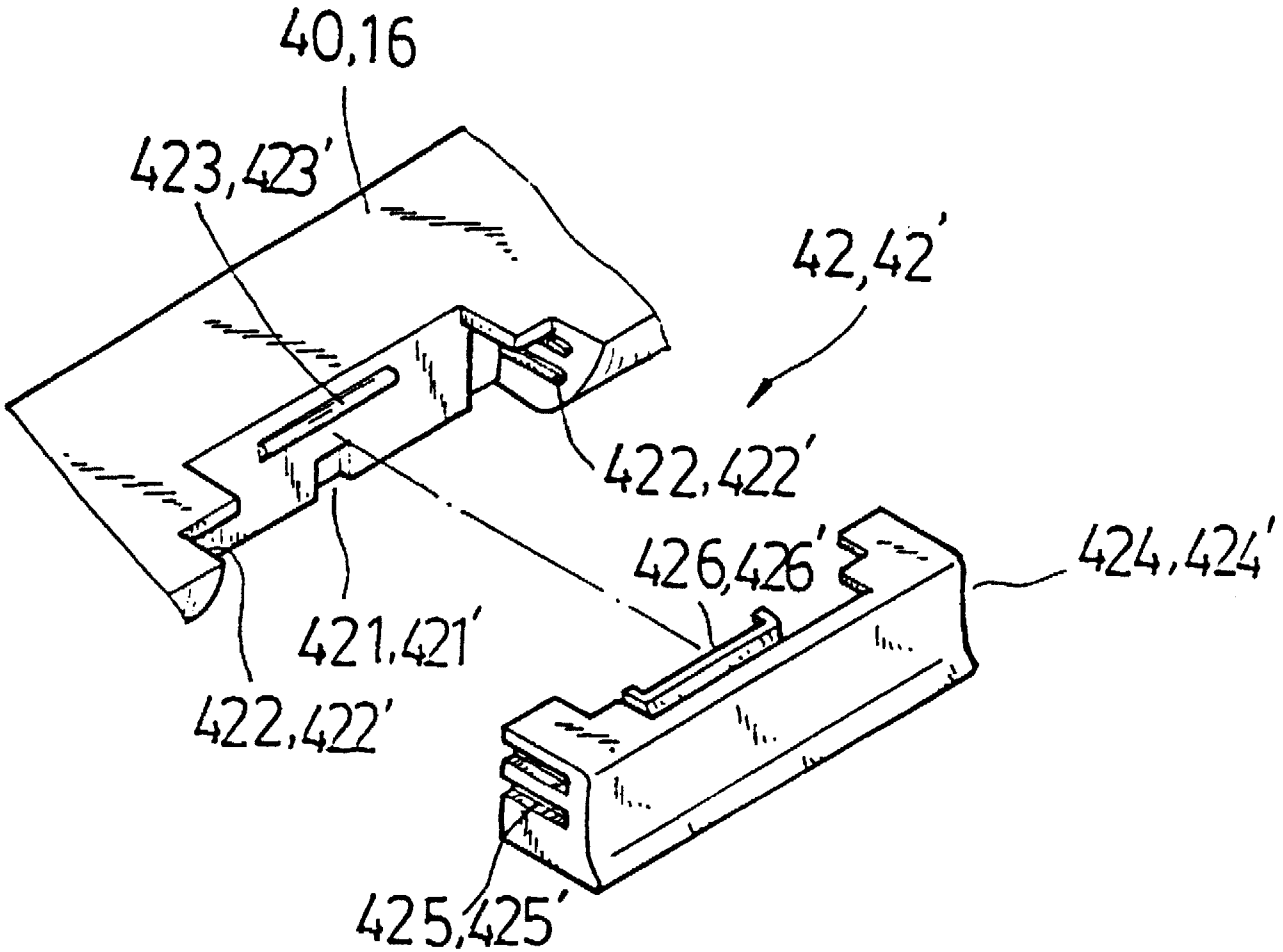
FIG. 2B is an exploded view of a locking structure according to the present invention.
Figure 2D:
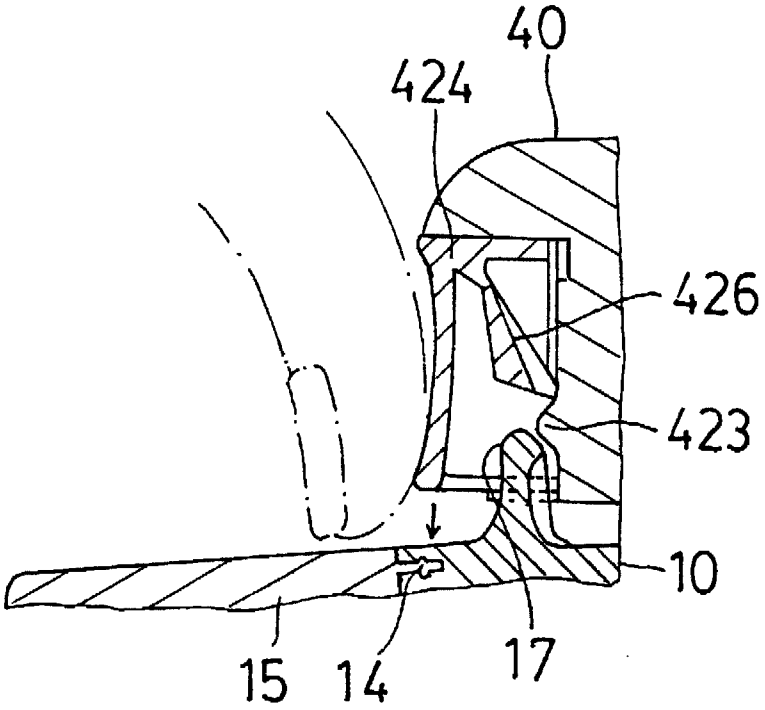
FIG. 2D is similar to FIG. 2C but showing the first locking structure unlocked.
Figure 2C:
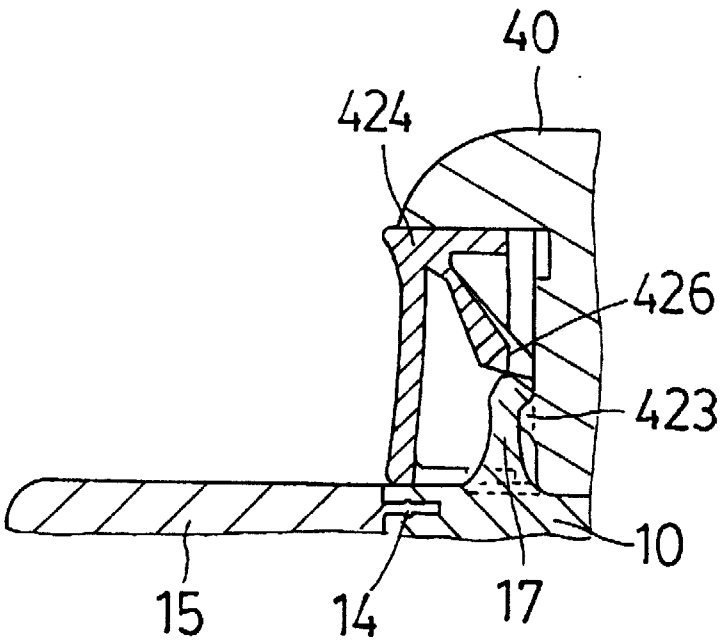
FIG. 2C is a sectional of a part of the powder storage and applicator device shown in FIG. 2A, showing the first locking structure locked.

Referring to FIGS. from 2A to 2D, the casing to comprises a top-open chamber 11 adapted for holding a powdered beauty product such as prickly heat powder, talcum powder, etc., a coupling portion 12 at one end, a filling hole 13 through the coupling portion 12 and in communication with the top-open chamber 11, a projecting block 16 at an opposite end, two retainer rods 18 raised from two opposite lateral sides thereof, and a plurality of raised portions 19 at the bottom adapted for massaging. An end cap 15 is detachably fastened to one end of the casing 10 to close the filling hole 13, having a coupling portion 14 adapted for coupling to the coupling portion 12 of the casing 10. The screen 20 is adhered to the casing 10 at the top and covered over the top-open chamber 11, comprised of a flat sponge 201, and a piece of filter cloth 202 covered on the flat sponge 201. The cover plate 30 is adapted for covering on the casing 10 over the screen 20, having two downward coupling flanges 31 longitudinally disposed at two opposite sides, and two projecting strips 32 respectively raised from the downward flanges 31 at an outer side in the middle. When the cover plate 30 is covered on the casing 10 over the screen 20, the two downward coupling flanges 31 are respectively attached to two opposite lateral sides of the casing 10, and the projecting strips 32 are respectively forced into engagement with the retainer rods 18 of the easing 10. When the projecting strips 32 are forced into engagement with the retainer rods 18, the cover plate 30 is secured in place. The handle 40 has one end pivoted to one end of the casing 10 above the projecting block 16 by a pivot pin 41. When installed, the handle 40 can be turned inwards and covered on the cover plate 30, or turned outwards from the casing 10. A first locking structure 42 is made at the free end of the handle 40. The first locking structure 42 comprises an opening 421 at the free end of the handle 40, two tracks 422 at two opposite sides of the opening 421, a locating rib 423 inside the opening 421 between the tracks 422, and a press block 424 coupled to the opening 421. Further, the casing 10 has a tab 17 raised from the top near one end remote from the projecting block 16. The press block 424 comprises two guide grooves 425 at two opposite sides adapted for coupling to the tracks 422, a springy tongue 426. When the guide grooves 425 of the press block 424 are coupled to the tracks 422, the springy tongue 426 is stopped below the locating rib 423. When the handle 40 is covered on the cover plate 30, the tab 17 is forced into engagement between the locating rib 423 and the springy tongue 426 (see FIG. 2C), and therefore the handle 40 is retained closed. When the press block 424 is depressed, the spring tongue 426 is forced to push the tab 17 away from the locating rib 423, and therefore the handle 40 is disconnected from the constraint of the tab 17 and can be turned outwards from the easing 10 (see FIG. 2D).

Figure 3:
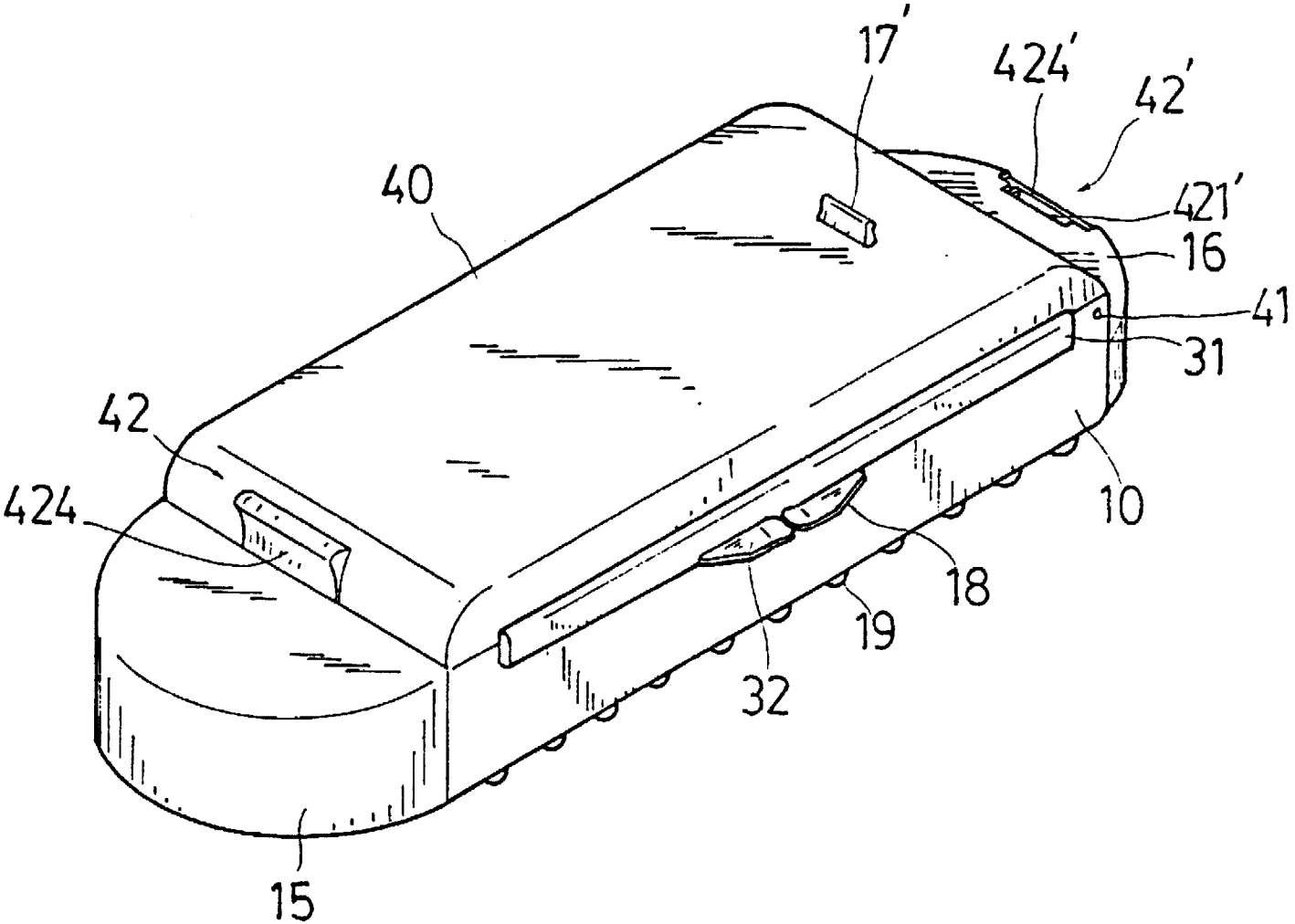
FIG. 3 is an elevational view of the powder storage arid applicator device shown in FIG. 2A.
Figure 4:
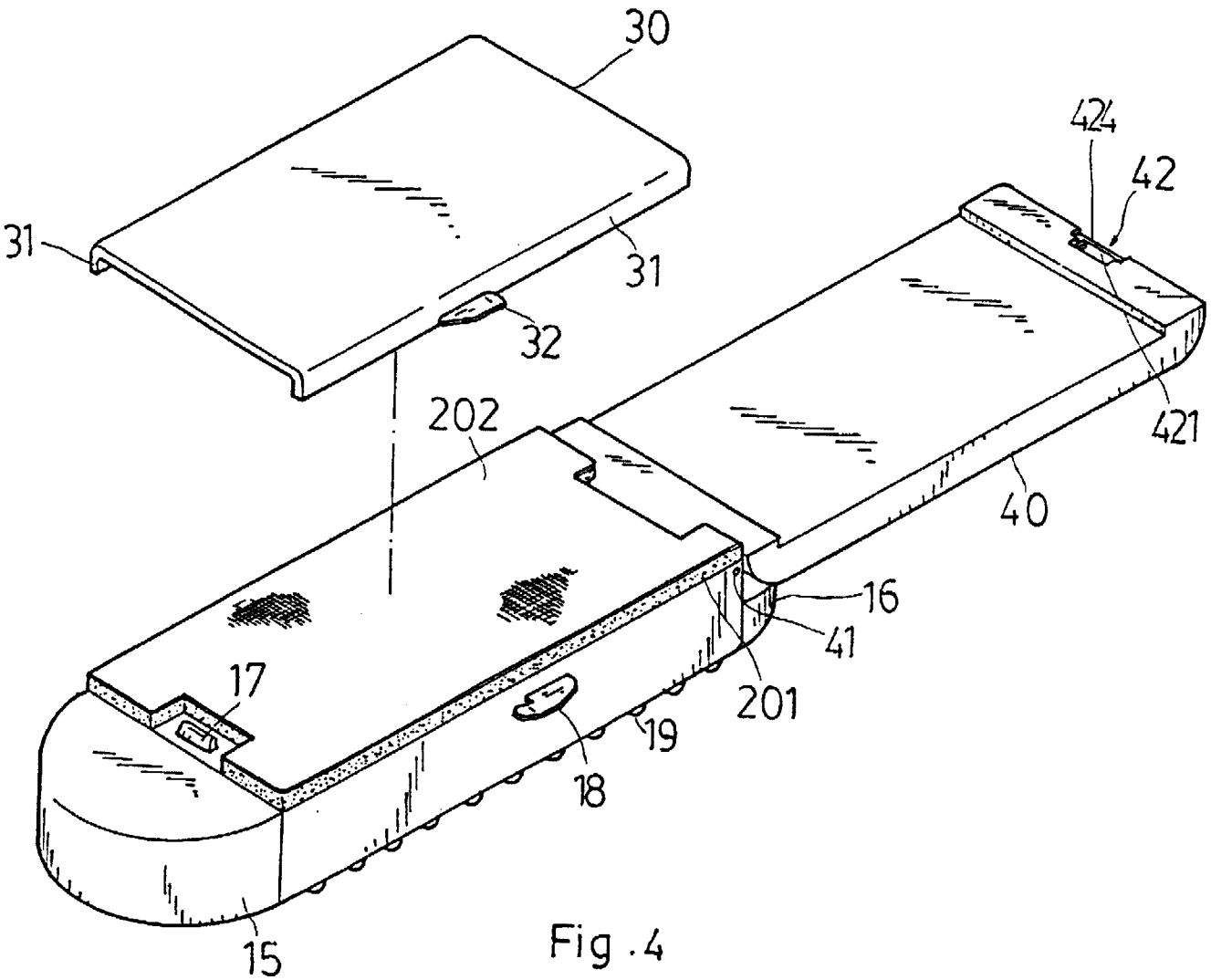
FIG. 4 is an applied of the present invention, showing the cover plate removed from the casing, and the handle extended out; and, FIG. 5 is an exploded view of a powder storage and applicator device according to a second embodiment of the present invention.

Referring to FIGS. 3 and 4, and FIG. 2B again, a second locking structure 42' is made at the free end of the projecting block 16. The second locking structure 42' is similar to the aforesaid first locking structure 42, comprising an opening 421' at the free end of the projecting block two tracks 422' at two opposite sides of the opening 421', a locating rib 423' inside the opening 421' between the tracks 422', a press block 424' coupled to the opening 421'. Further, the handle 40 has a tab 17' raised from the outside. The press block 424' comprises two guide grooves 425' at two opposite sides adapted for coupling to the tracks 422', and a springy tongue 426'. The operation of the second locking structure 42' is similar to that of the first locking structure 42. When the handle 42 is turned outwards from the casing 10, the locating tab 17' is forced into engagement between the locating rib 423' and the springy tongue 426', and therefore the handle 40 is retained in the operative position outside the casing 10. When in use, the desired powdered beauty product is filled into the top-open chamber 11 of the casing 10 through the filling hole 13, then the end cap 15 is fastened to the casing 10 to close the filling hole 13, and then the handle 40 is turned outwards and secured in the operative position and the cover plate 30 is removed from the casing 10. Thus, the user can apply the powdered beauty product to any part of the body conveniently and evenly, by patting the desired part of the body with the filter cloth 202 of the screen 2, or gently rubbing the filter cloth 202 of the screen 2 over the desired part of the body. Because the filter cloth 202 is supported on the sponge 201, the powdered beauty product can be smoothly and gently applied to the body. Because the filter cloth 202 and the sponge 201 have evenly distributed open spaces, the powdered beauty product can be evenly applied to the body. Furthermore, through the handle 40, the user can move filter cloth 202 of the screen 20 over any part of the body, for example, the back of the body. When not in use, the cover plate 30 is covered on the casing 10 over the screen 20, and then the handle 40 is turned inwards arid closed on the cover plate 30 (see FIG. 3). Furthermore, when the powder storage and applicator device is closed, it can be used as a manual massaging means for massaging the muscles and joints by means of the raised portions 19.

Figure 5:
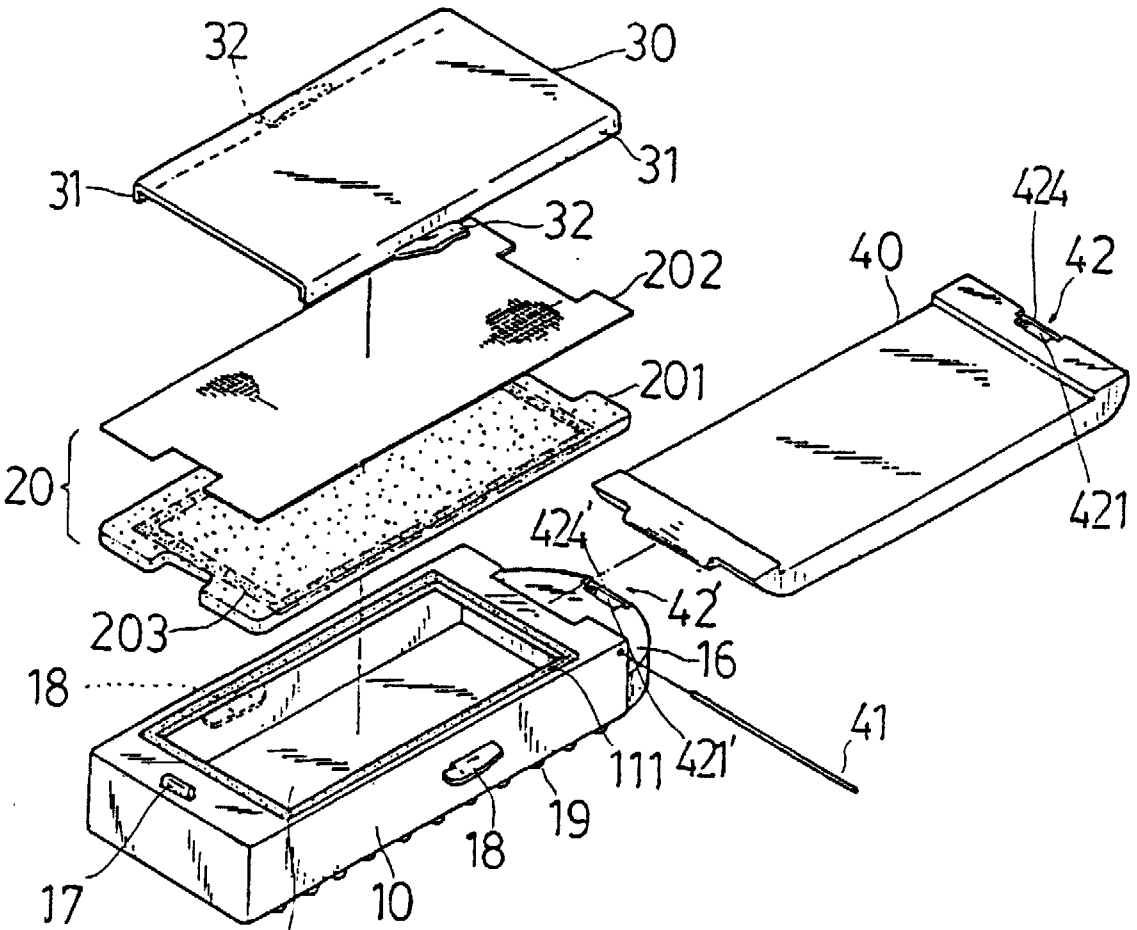

FIG. 5 shows an alternate form of the present invention. According to this alternative form, the screen 20 is detachably fastened to the casing 10 by loop and hook materials 111, 203. When the screen 20 is detached from the casing 10, a powdered beauty product can then be filled into the top-open chamber 11 of the casing

I claim:

1. A powder storage and applicator device comprising:

a casing having a top-open chamber, which holds a powder, and a projecting block at one end;

a screen covered on said casing over said top-open chamber, and adapted for applying said powder to the body of a person by patting the body with said screen or rubbing said screen over the body, said screen comprising a flat sponge, and a filter cloth covered on said flat sponge;

a cover plate covered on said screen;

a flat handle pivotably connected to one end of said casing by a pivot pin, and turned between a first position in which said handle is closed on said screen and said casing, and a second position in which said handle is supported on said projecting block and aligned with said casing in a line;

first press lock means adapted for securing said handle in said first position; and, second press lock means adapted for securing said handle in said second position.

2. The powder storage and applicator device of claim 1 wherein said casing further comprises two retainer rods at two opposite sides adapted for securing said cover plate in place; said cover plate comprises two downward coupling flanges longitudinally disposed at two opposite sides and adapted for attaching to two opposite lateral sides of said casing, and two projecting strips respectively raised from said downward flanges at an outer side in the middle and adapted for engaging the retainer rods of said easing.

3. The powder storage and applicator device of claim 1 wherein said casing further comprises a coupling portion at one end, a powder filling hole through said coupling portion and in communication with said top-open chamber, and an end cap adapted for coupling to said coupling portion to close said powder filling hole.

4. The powder storage and applicator device of claim 1 wherein said screen is detachably secured to said casing by loop and hook materials.

5. The powder storage and applicator device of claim 1 wherein said casing further comprises a plurality of raised portions at a bottom side thereof adapted for massaging.

* * * * *